United States Patent [19]

Küssel et al.

[11] 4,130,772

[45] Dec. 19, 1978

[54] LIQUID-COOLED ROTARY ANODE FOR AN X-RAY TUBE

[75] Inventors: Eckhard Küssel, Düren; Heinz G. Haubold, Jülich; Franz Joswig, Jülich; Karl H. Klatt, Jülich, all of Germany

[73] Assignee: Kernforschungsanlage Julich Gesellschaft mit beschrankter Haftung, Julich, Germany

[21] Appl. No.: 886,391

[22] Filed: Mar. 14, 1978

[30] Foreign Application Priority Data

Mar. 18, 1977 [DE] Fed. Rep. of Germany ..... 2711848

[51] Int. Cl.[2] ..... H01J 35/10

[52] U.S. Cl. ..... 313/32; 313/60

[58] Field of Search ..... 313/60, 12, 32, 30

[56] References Cited

U.S. PATENT DOCUMENTS 3,870,916 3/1975 Kussel et al. ..... 313/60 X

*Primary Examiner*—Rudolph V. Rolinec
*Assistant Examiner*—Darwin R. Hostetter
*Attorney, Agent, or Firm*—Flynn & Frishauf

[57] ABSTRACT

The cylindrical peripheral wall (5) of a rotating hollow body mounted on a shaft (1) driven by an electric motor within the stem casing of an X-ray tube is cooled with water supplied and removed respectively through coaxial ducts in the drive shaft, distributed by radial ducts in one end face of the rotary body to a ring duct and gathered from a ring duct at the other end face through another set of radial ducts leading back to the shaft. Between the two ring ducts the cooling medium flows through helical cooling ducts running parallel to each other and at an angle of about 15° to the edge boundaries of the cylindrical operating surface. These ducts are formed on the outside by the anode peripheral wall material itself and on the inside by a stainless steel insert. The anode is degassed when its structure is soldered or brazed together in high vacuum at 1000° C.

3 Claims, 3 Drawing Figures

LIQUID-COOLED ROTARY ANODE FOR AN X-RAY TUBE

This invention concerns a rotary water-cooled anode for an X-ray tube, particularly of the kind having a hollow body with a substantially cylindrical outer wall made of an electron-target material for producing X-rays when bombarded with electrons from a fixed cathode.

Such a rotary anode, having radial supply and discharge ducts within the hollow space for the water supplied and removed through a hollow drive shaft for the anode was described in the Philips Technical Review, Vol. 19, 1957/58, No. 11, pp. 362 to 365. In this rotary anode, constituted as a hollow cylinder, three radially running tubes were provided through which the water would reach a cavity located along the inner surface of the peripheral wall or anode strip of the hollow body. In this device, the water flows back into the hollow drive shaft through three other tubes running radially in the rotary anode. There is a disadvantage in this known rotary anode, however, that only relatively low speeds of rotation can be obtained with it, because the peripheral wall provided as the anode target member, which cannot exceed a certain thickness on account of the cooling to be obtained, is not able to withstand the pressures in the cooling medium that arise at higher speeds of revolution as the result of centrifugal force. Only relatively small surface density of illumination (brightness) can be obtained with this known rotary anode, because the intensity of illumination, ie. radiation per unit of surface, obtainable depends upon the rate of revolution that can be used.

It is an object of the invention to provide a rotary anode of symmetrical construction with respect to the axis of rotation with which operation is possible, even in the range of speed above 10,000 r.p.m., up to about 12,000 r.p.m.

SUMMARY OF THE INVENTION

Briefly, in a rotary anode of the general type above described, the radial supply ducts for the cooling medium are connected together by a first ring duct, both these radial supply ducts and the first ring duct being located on the inner surface of a first end wall of the hollow body of which the anode is constituted, while the radial cooling medium discharge ducts are connected together by a second ring duct, these discharge ducts and the second ring duct being located on the inner surface of a second and axially opposite end wall of the hollow body. From the first ring duct to the second ring duct, there run a plurality of cooling ducts evenly distributed over the peripheral wall of the anode, these cooling ducts running parallel to each other and obliquely along the inside of the peripheral wall of the anode, each such cooling duct having a length not less than 150 mm nor greater than 250 mm. The cooling ducts running between the first and second ring duct are formed on the outside by the material of the peripheral wall of the anode and on the inside by a material of high mechanical strength which extends between the cooling ducts and is firmly connected to the material of the peripheral wall preferably by brazing or soldering.

In the above-described provision of a cooling duct system in the rotary anode in accordance with the invention, it is possible to keep the cross-sections of the individual ducts small and yet to provide a sufficient cooling of the material forming the operating portion (electron target) of the rotary anode.

A high mechanical strength of the peripheral wall of the anode can be obtained by construction of the cooling duct system of the rotary anode in accordance with the invention. The peripheral wall is commonly made of copper or of copper with a coating layer of molybdenum, silver or tungsten. This result can be obtained particularly when the duct sections connecting the ring ducts run parallel to each other and at an oblique angle (preferably 10° to 15°) to the edge boundaries of the peripheral wall of the anode, and the mechanically strong material used for the provision of the cooling ducts extends between the individual ducts and is firmly bonded to the material of the peripheral wall. Stainless steel is preferred for the mechanically strong material.

The X-ray tube anode according to the invention is usable at speeds up to 12,000 r.p.m. without risk of overloading the material of which the anode is formed on account of the pressure of the cooling medium arising within the cooling ducts, which pressure reaches about 90 bars in the case of a rotary anode with a diameter of 250 mm. It has been found practical in such cases, where a hollow body of a diameter of 250 mm is used for the anode, to require that the cross-section of the ducts arranged in the hollow body in the peripheral region thereof should not have a cross-sectional area exceeding 0.5 $cm^2$, and that the portion of the individual cooling ducts constituted of the material of the peripheral wall of the anode should have a width that does not exceed 6 mm.

The invention is further described by way of illustrative example, with reference to the annexed drawings, in which.

Figure 1:
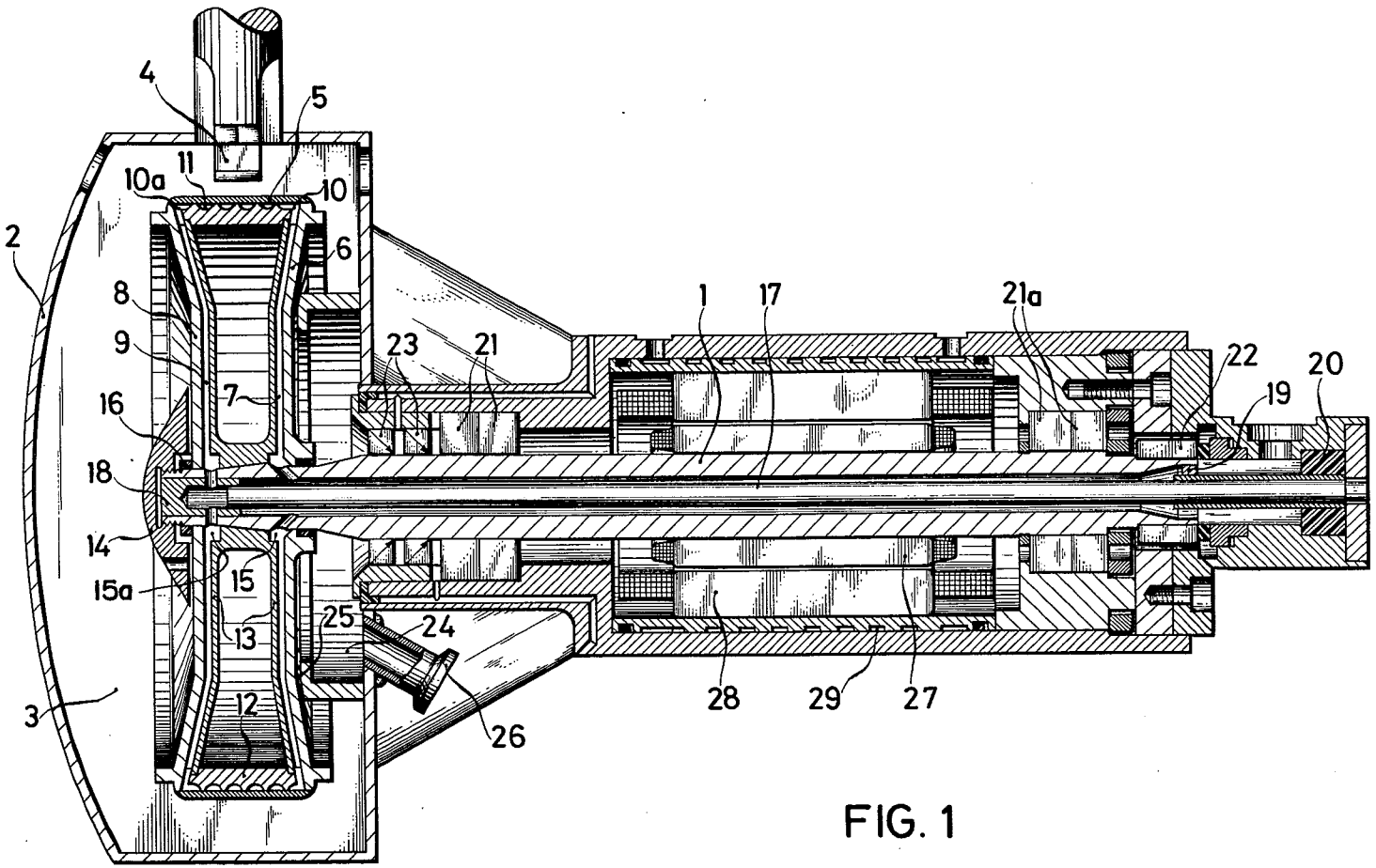
FIG. 1 is a longitudinal section passing through the axis of an X-ray tube.
Figure 2:
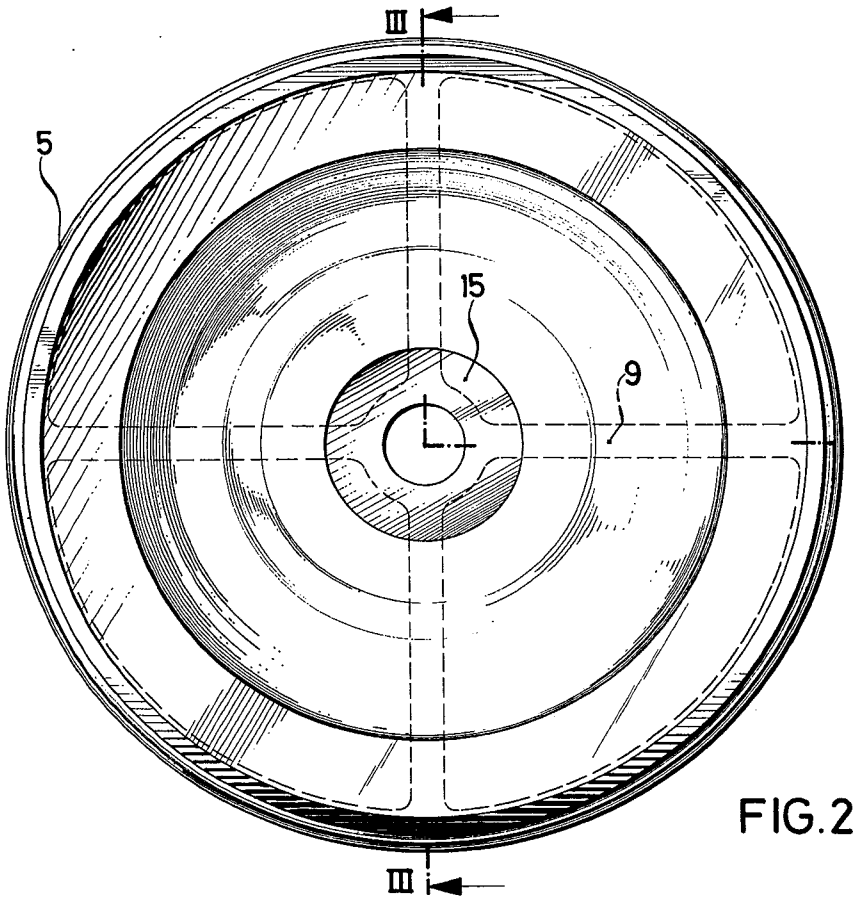
FIG. 2 is a cross-section through the rotary anode of the X-ray tube of FIG. 1, perpendicular to the tube axis, and FIG. 3 provides, to the left of the vertical axis, a radial cross-section of the rotary anode, and to the right of the axis, a side view with the peripheral anode strip wall stripped away.
Figure 3:
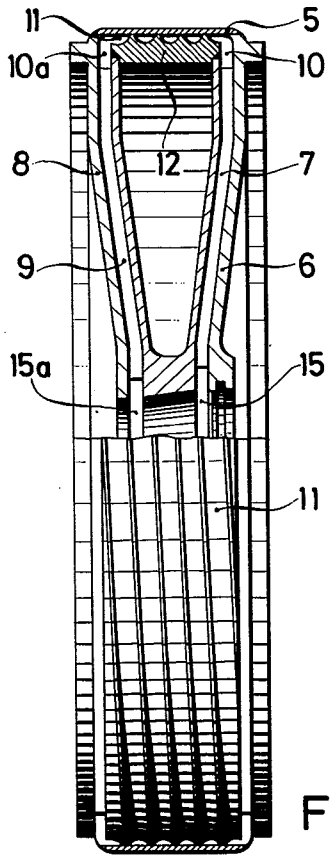

As shown in FIG. 1, an X-ray tube is provided with a rotary anode connected to a hollow drive shaft 1 located in a high-vacuum space 3 enclosed by the casing or envelope 2, into which the cathode 4 projects. The rotary anode, as can be seen in FIG. 3 as well as in FIG. 1, is constituted as a hollow body with a peripheral wall 5 providing the anode surface and consisting of copper. The rotary anode structure has cooling medium supply ducts 7 running radially on the inside of the end wall 6 of the rotary anode, and an equal number of discharge ducts 9 for the cooling medium running radially on the other end wall 8. Both the supply ducts 7 and discharge ducts 9 are connected together at their outer ends with a ring duct 10, **10*a*. The two ring ducts 10 and 10*a* are connected together by duct sections 11, which may be referred to as cooling ducts. The material of the peripheral wall 5 forms the outer boundaries of the cooling ducts 11 and a part 12 made of stainless steel forms the inner boundaries of the cooling ducts 11. As is visible in the right-hand portion of FIG. 3, the cooling duct sections 11 run at an angle of about 15° to the edge boundaries of the peripheral wall 5 of the rotary anode. These cooling ducts are parallel to each other and evenly distributed over the inside surface of the peripheral wall 5. The part 12 is soldered to the peripheral wall 5 of the hollow body of the anode and also to the inner part 13 forming the ducts 7 and 9, and the peripheral wall 5 is also soldered to the end surface covers 6 and 8. During the soldering or brazing of these several parts at 1000° C. in high vacuum the rotary anode is degassed so that no more gas will be set free when the peripheral wall 5** is bombarded with electrons.

As can be seen, furthermore, from FIG. 1, the axially symmetric rotary anode body is removably connected with the drive shaft 1. The rotary anode body is slipped onto the conically shaped part of the drive shaft 1 to mount it in position, and is then screwed down fast by means of the nut 14. Openings are provided in the conical end portion of the drive shaft for the supply and discharge of the cooling medium. These openings connect with central ring ducts 15 and 15*a* which respectively connect with the radially running ducts 7 and 9. The inner tube 17 which is provided co-axially in the drive shaft 1 is firmly held in the drive shaft by the end piece 18 and by a holder 19 consisting of ring segments, and it is also supported in a graphite slip bearing 20.

The drive shaft 1 is mounted in two bearings 21 and 21*a* shown in FIG. 1. Between the drive shaft and casing of the x-ray tube is a slip ring seal 22. In addition there is provided a radial seal 23 and a space 24 between the shaft bearing which is the nearer to the rotary anode, the bearing 21, and the rotary anode, the space 24 being separated from the space 3 surrounding the rotary anode by a gap seal 25. The space 24 is connected through an evacuation fitting pipe 26 to a high-vacuum pump not shown in the drawing.

The anode drive of the X-ray tube consists, as shown in FIG. 1, of an electric motor mounted between the bearings 21 and 21*a*, having a rotor 27 co-axial with drive shaft 1 firmly mounted on the drive shaft preferably by being shrunk thereon. The stator 28 of the electric motor is mounted in fixed relation to the casing of the tube. Ducts 29 for a cooling medium are provided for cooling the motor. The X-ray tube shown in the drawing can be operated with a continuous power consumption of 100 KW.

Although the invention has been described with reference to a particular illustrative example, it will be evident that modifications and variations are possible within the inventive concept.

The cooling medium is preferably water, which has proved itself to be an effective cooling medium for various kinds of high-power electron tubes.

The invention can advantageously be combined with features of a related invention described in a copending application of one of the present applicants (Kussel) Ser. No. 886,416.

We claim:

1. An axially symmetrical rotary anode for an X-ray tube, comprising a hollow body mounted on a hollow drive shaft and having a substantially cylindrical peripheral wall of a material capable of emitting X-rays when irradiated with electrons and containing ducts for leading a liquid cooling medium into and away from cooling relation with said peripheral wall and from and to respective ducts in said shaft, and comprising the improvement consisting in that:

a plurality of radial cooling medium supply ducts (7) are connected together by a first ring duct (10) and both said radial supply ducts and said first ring duct are located on the inner surface of a first axial-end wall of said hollow body;

a plurality of radial cooling medium discharge ducts (9) are connected together by a second ring duct (10*a*) and both said radial discharge ducts and said second ring duct are located on the inner surface of a second and axially opposite end wall of said hollow body;

a plurality of cooling ducts (11) run parallel to each other, obliquely along the inside of said peripheral wall (5), from said first ring duct (10) to said second ring duct (10*a*), evenly distributed over said peripheral wall (5), and each such cooling duct (11) has a length not less than 150mm nor greater than 250mm, and said cooling ducts (11) are formed on the outside by the material of said peripheral wall (5) and on the inside by a material of high mechanical strength extending between the cooling ducts and firmly connected to the material of said peripheral wall (5).

2. A rotary anode for an X-ray tube as defined in claim 1 in which cross sections of the respective, supply, cooling and discharge ducts (7,9,11) in the neighborhood of the periphery of said hollow body does not exceed 0.5 $cm^2$ in the case of a hollow body having a diameter not greater than 250mm.

3. A rotary anode for an X-ray tube as defined in claim 2 in which the width of the portion of each of said cooling ducts (11) that is constituted of the material of said peripheral wall (5) does not exceed 6mm.

* * * * *